United States Patent [19]

Labbé

[11] Patent Number: 4,567,752

[45] Date of Patent: Feb. 4, 1986

[54] CIGARETTE MONITORING

[75] Inventor: Francis A. M. Labbé, Neuilly-sur-Seine, France

[73] Assignee: Molins, Plc., London, England

[21] Appl. No.: 448,272

[22] Filed: Dec. 9, 1982

[30] Foreign Application Priority Data

Dec. 9, 1981 [GB] United Kingdom ..... 8137106

[51] Int. Cl.[4] ..... A24C 5/00

[52] U.S. Cl. ..... 73/37.6; 73/38; 73/73; 131/904

[58] Field of Search ..... 73/37.6, 37.7, 38, 73; 131/904, 905, 906

[56] References Cited

U.S. PATENT DOCUMENTS

| | | | |
|---|---|---|---|
| 3,585,844 | 6/1971 | Dornseiffen | 73/37.7 |
| 3,633,590 | 1/1972 | Pocock et al. | 73/37.7 X |
| 3,841,337 | 10/1974 | Varner | 131/905 X |
| 4,121,450 | 10/1978 | Zurcher | 73/37.6 X |
| 4,280,516 | 7/1981 | Reuland | 131/906 X |
| 4,284,087 | 8/1981 | Reuland | 131/906 X |
| 4,326,542 | 4/1982 | Laszlo et al. | 131/906 X |

FOREIGN PATENT DOCUMENTS

| | | | |
|---|---|---|---|
| 616808 | 3/1961 | Canada | 73/37.6 |
| 1392934 | 5/1975 | United Kingdom | 131/906 |

*Primary Examiner*—Stewart J. Levy
*Assistant Examiner*—Joseph W. Roskos
*Attorney, Agent, or Firm*—Antonelli, Terry & Wands

[57] ABSTRACT

A cigarette making machine includes apparatus for determining the internal pressure of an axially moving cigarette rod comprising forming a continuous rod in which a wrapper web surrounds a tobacco filler including an endless impervious flexible tape arranged to be wrapped around at least part of the circumference of the rod, a guide through which the rod and tape are arranged to pass, means for supplying air under pressure to the guide to enter a gap between the guide and the tape; and a monitor for monitoring a physical characteristic of the supplied air. Also included is compensating for the effect which moisture in the tobacco has on the internal pressure of the cigarette rod.

36 Claims, 4 Drawing Figures

CIGARETTE MONITORING

In the cigarette industry particular brands of cigarettes are produced within specified quality limits while maintaining efficient production and minimizing waste. That is best achieved by measuring characteristics of the tobacco during manufacture, producing estimates relating to the quality of the finished product and using these estimates for controlling the operation of the machine. Difficulties arise, however, owing to the many different types of blends used in modern production, including for example tobaccos from different regions and expanded tobaccos. The object of the present invention is therefore to improve the measurement of parameters relating to the production of cigarettes, and to provide accurate information indicative of the quality of the finished product, particularly but necessarily for the purpose of controlling the manufacture in order to achieve uniformity of the product.

In this context reference is made to cigarettes, but the term "cigarette" is intended to include other articles of the tobacco industry which are manufactured by similar techniques.

According to a first aspect of the invention there is provided a method of determining the internal pressure of an axially moving cigarette rod, comprising, wrapping an endless impervious flexible tape at least partly around the rod, passing the wrapped rod through a guide, supplying air under pressure to the guide to produce a gap between the tape and the guide; and monitoring a physical characteristic of the supplied air to provide an indication of the internal pressure of the rod-shaped article.

The flexible tape is preferably a garniture tape which also serves to wrap the cigarette wrapper around the tobacco filler.

Characteristics of the tobacco can also be measured before the rod is formed. According to the second aspect of the invention there is provided a method of monitoring a tobacco stream which, after trimming, is enclosed in a wrapper web to form a continuous cigarette rod, in which the air pressure in the tobacco stream is sensed at a first position spaced from a conveyor carrying the tobacco stream and is compared with the pressure at a second position above or below the tobacco stream. The first position preferably corresponds approximately to the average trimming level. If the second position is then located adjacent to the conveyor, the pressure comparison can be used to determine the specific volume of the tobacco used to form the cigarette rod (preferably with compensation for the actual instantaneous trimming level). Alternatively (or in addition), the second position may be so positioned as to indicate the pressure in the space adjacent to the surface of the tobacco stream remote from the conveyor; in that case the pressure comparison can be used to determine the discard ratio (as explained below), preferably again with compensation for the actual trimming level.

It is also useful for a cigarette manufacturer to know the "dry firmness" of the cigarette, i.e. the firmness when the cigarettes reach the smoker. According to the third aspect of the invention there is provided a method of determining the dry firmness of cigarettes in which the firmness is measured at the time of making the cigarettes, and the signal obtained thereby is compensated by reference to the moisture content of the tobacco and by reference to the specific volume of the tobacco.

The dry firmness measurement thus obtained may be used to control the amount of tobacco used in the formation of the cigarettes. Preferably the specific volume is deduced from the filler air resistance, preferably calculated in a manner according to the second aspect of this invention, and from the filler density. The tobacco specific volume is defined as the volume, for a unit mass of tobacco, which is occupied by the actual tobacco particles, including the volume of the air trapped within the particles but not the air surrounding the particles.

Preferably the tobacco moisture content is calculated from the tobacco filler capacitance, the filler density and the temperature of the tobacco, compensated by reference to the specific volume.

The present invention will be described, by way of example, with reference to the accompanying drawings in which.

Figure 1:
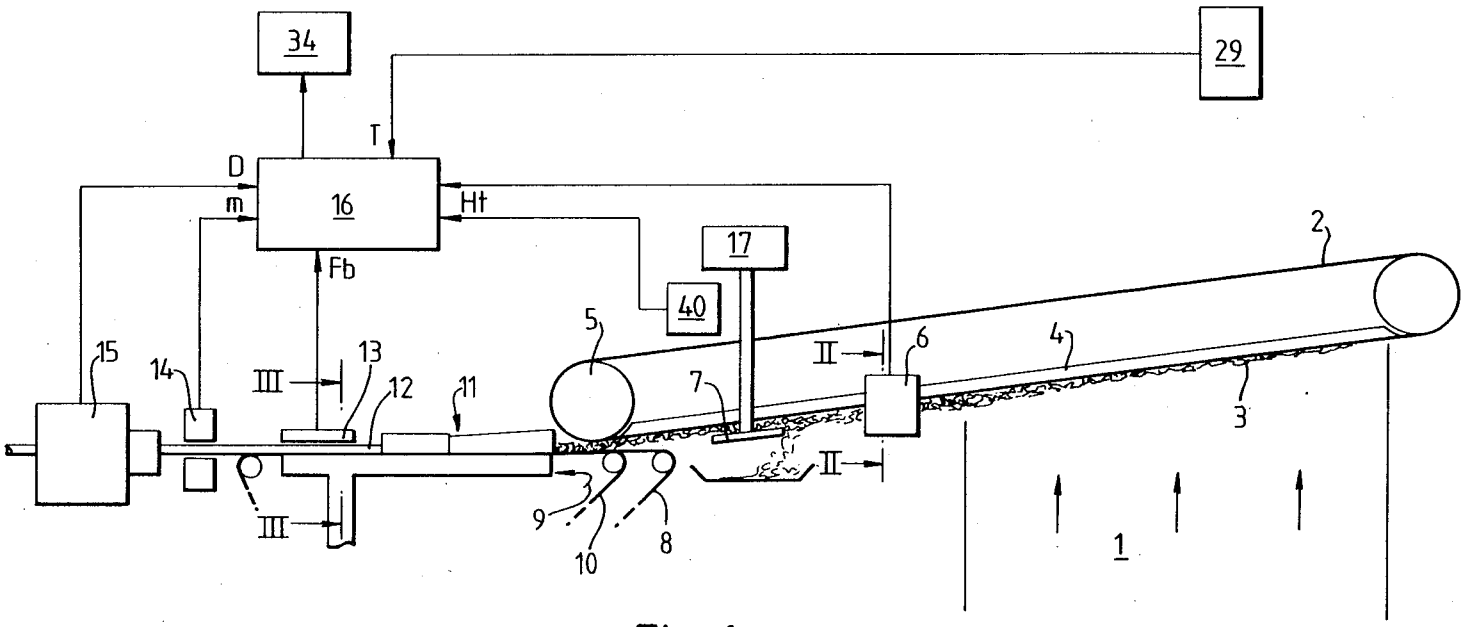
FIG. 1 is a schematic side elevation of a continuous cigarette rod making machine incorporating the various aspects of the present invention.

The cigarette rod making machine of FIG. 1 is basically like a Molins Mk 8 or Mk 9 machine and may incorporate further details of either of those machines. It comprises a chimney 1 arranged to shower tobacco onto an endless suction conveyor 2 driven by pulleys 5 to form a stream of tobacco 3. The stream of tobacco 3 is held on the conveyor 2 by suction applied in a suction chamber 4 and is thus conveyed through an air cell 6 and past a trimmer unit 7.

At the end of the suction chamber 4 the tobacco stream 3 is transferred from the conveyor 2 onto a paper web 8 which is supported and driven, in the direction of arrow 9, by a garniture tape 10. The stream of tobacco 3 is thus guided through a rod-forming arrangement 11 which folds the paper web 8 longitudinally around the tobacco filler stream 3, applied an adhesive such as PVA to one lap edge of the paper web 8, and seals the lap joint by applying heat to set the adhesive.

A continuous cigarette rod 12 is thus produced and is carried by the garniture tape 10 through an air bearing arrangement 13. The rod then emerges from the garniture tape and passes through a nucleonic weight scanner 14 and then through a diameter gauge 15 before being cut into discrete rod lengths by a cutter (not shown).

The air cell 6 is shown and described in more detail with reference to FIG. 2 (see later). It generates signals from which a microprocessor 16 calculates various values in connection with the filler stream.

The height H of the trimmer 7, that is the effective distance of the trimmer from the suction conveyor, is controlled by a motor 17; that determines the thickness of the tobacco stream which goes into the formation of the cigarette rod. A trimmer position sensor 40 generates a signal representing the trimmer height H which is also fed to the microprocessor 16. A possible arrangement of the trimmer 7 and its 25 height control is described in British Pat. No. 929,338.

The air bearing arrangement 13 is shown and described in more detail with reference to FIG. 3 (see later). This provides an indication of the internal pressure Pi in the tobacco rod. A signal representing this pressure is also fed to the microprocessor 16.

The nucleonic scanner 14 may be as described in British Pat. No. 1,342,064 and may correspond to our MODIC or MAID equipment. This scanner furnishes a signal m indicative of the mass per unit length of the rod 12, assuming the rod diameter is at the target value. The signal m can be compensated for the actual measured diameter of the rod to calculate the actual cigarette mass M per unit length, and the average mass of end sections of the cigarettes. The average end sections mass may also be obtained directly from a separate cigarette ends inspector (not shown).

A signal D representing the rod diameter is fed to the microprocessor 16 from the rod diameter gauge 15, which may be as described in U.S. Pat. No. 2,952,262.

The microprocessor 16 also receives an indication of the tobacco temperature T from a temperature sensor 29 (e.g. a thermistor) which may be located in the tobacco hopper (not shown) of the machine, or in the suction chamber 4 near the trimmer.

From all the data input to it, the microprocessor 16 calculates characteristics of the finished article and displays such information on a display unit 34. Alternatively, or in addition, information can be fed to a central management control system either for instant display or for storage, or for both. A signal indicative of the firmness of the finished rod may be used to control the trimmer height preferably after correction to compensate for moisture variations so that the trimmer is controlled in response to the "dry firmness".

The way in which the microprocessor 16 takes account of all the data in its calculations is described more fully later with reference to FIG. 4.

Figure 2:
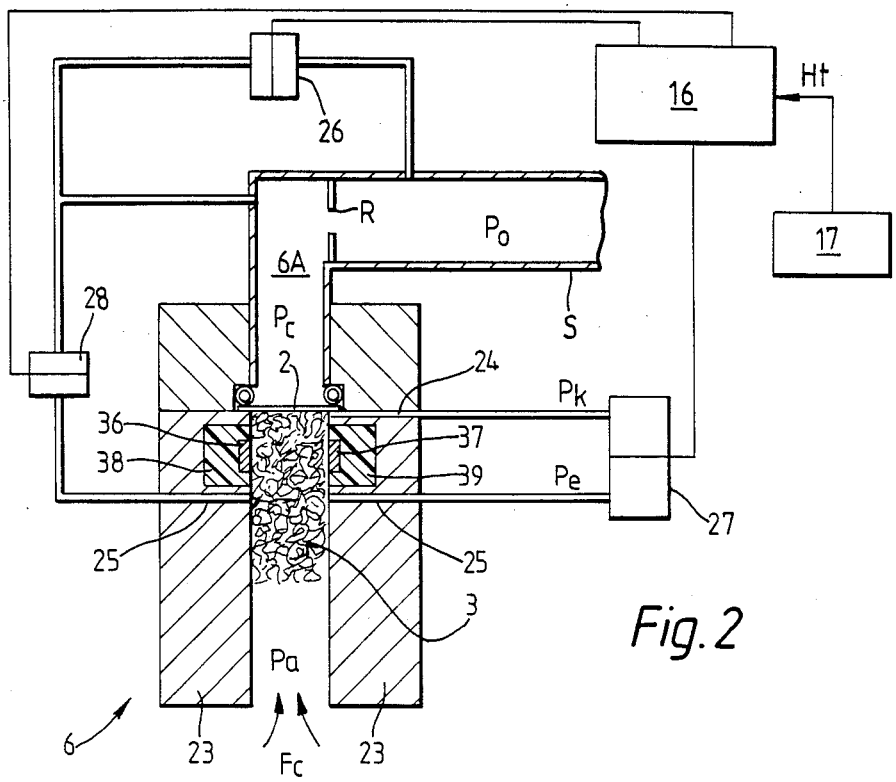
FIG. 2 is a cross-section on line II—II in FIG. 1 showing part (the air cell) in more detail.

FIG. 2 is a cross-sectional view on line II—II in FIG. 1. It shows the air cell 6 in more detail, together with associated pneumatic circuitry.

The tobacco stream 3 is carried on the endless suction conveyor 2 between side walls 23. The tobacco is held on the conveyor 2, before and after the air cell, by suction in the suction chamber 4 above the conveyor 2 (not shown in FIG. 2). A suction pressure Pc is maintained in a chamber 6A of the air cell by the application of suction pressure Po from a suction source S via a restrictor R having a resistance to air flow Rs. The side walls 23 are formed with channels 24 and 25 through which the suction pressure Pk immediately below the suction conveyor 2 and the suction pressure Pe at the average trimming height He are respectively sensed.

In this context reference will for convenience be made to "resistance" where it would in fact be more correct to refer to the "coefficient of resistance".

A pressure transducer 26 is subjected to the applied pressure Po and to the chamber pressure Pc to generate a signal representing the difference Po−Pc. This gives an indication of the flow rate through the restrictor R. A second transducer 27 generates a signal representing the difference between the suction pressure Pk immediately below the conveyor 2 and the pressure Pe at the average trimmer height He, i.e. Pk−Pe.

A third pressure transducer 28 is subjected to the chamber pressure Pc and to the pressure Pe to generate a signal representing the difference Pc−Pe. Each of these signals is fed to the microprocessor 16. If the pressure Pa below the tobacco stream is not atmospheric, perhaps owing to a suction enclosure, it would be measured and taken into account.

The approximate resistance Rf to air flow of the filler stream (i.e. that part of the tobacco stream 3 that lies above the channel 25) can be derived from Pc, Pk and Pe by the formula:

$$Rf=Rs(Pk-Pe)/(Po-Pc)$$

Alternatively Rf may be calculated without Pk, if the resistance Rk due to the suction conveyor 2 is known, by the formula:

$$Rf=Rs[(Pc-Pe)/(Ps-Pc)]-Rk$$

In practice the control motor 17 will drive the trimmer up and down around the average trimmer height He in response to control signals from the microprocessor 16. The actual height H of the trimmer, determined by the trimmer position sensor 40, is fed to the microprocessor 16 to provide a signal corresponding to the actual resistance of the part of the filler stream that remains after trimming.

From the measurements taken by the air cell 6 and the signal from the trimmer height detector 40, the microprocessor 16 calculates the discard ratio DR i.e. the ratio of tobacco removed (by the trimmer) to tobacco left to go into the cigarette rod. The discard resistance Rd is determined, being a measure of the air resistance of the tobacco below the average trimming level He and therefore an indication of the average amount of tobacco removed by the trimmer. The discard resistance Rd is directly related to the air pressure Pe at the average trimming level, and using the terminology of FIG. 2 is given by:

$$Rd=Rs(Pe-Pa)/(Po-Pc)$$

The discard ratio DR, corrected for the difference between the average trimmer height He and the actual trimming height H, is as follows:

$$DR=A(Rd)+B(He-H)$$

where A and B are constants which are determined experimentally for a particular machine, with a particular type of tobacco, and a particular cigarette rod weight per unit length. The latter is maintained accurately by the microprocessor (by varying the height of the trimmer); the constant A is related to the inverse of the rod weight. The constant B has been found by experiment in a typical situation to be approximately equal to 8%/mm.

It will be appreciated that the air cell 6 may be used quite independently of the other quality monitoring units illustrated in FIG. 1 to produce valuable and useful quality criteria, particularly in conjunction with the trimmer height sensor 40.

The channels 24 and 25 need not necessarily be located directly below the air cell, i.e. where pressure Pc is applied to the conveyor as illustrated in FIG. 2. For example, they may be located upstream of downstream of the air cell, where it will be assumed that pressure Po exists immediately above the conveyor 2 (i.e. in the chamber 4 in FIG. 1). In this case the equations relating the measured pressures to discard resistance and discard ratio will be slightly different, i.e.:

$$Rd=(Rf+Rk)(Pe-Pa)/(Ps-Pe)$$

and $$DR = A'(Pe - Pa) + B(He - H)$$

approximately where

A'=0.4%/mm. water gauge approximately

B=8%/mm. approximately

This expression for the discard ratio DR assumes that any air flow variations through the tobacco are small in relation to the required accuracy.

FIG. 2 also shows two capacitor plates 36 and 37, one embedded in each of the side walls 23 and surrounded by insulators 38 and 39 respectively. These enable the relative permittivity or dielectric constant of the filler stream to be measured. They may be placed at any suitable position along the filler stream, and do not have to be combined with the air cell as shown in FIG. 2.

Figure 3:
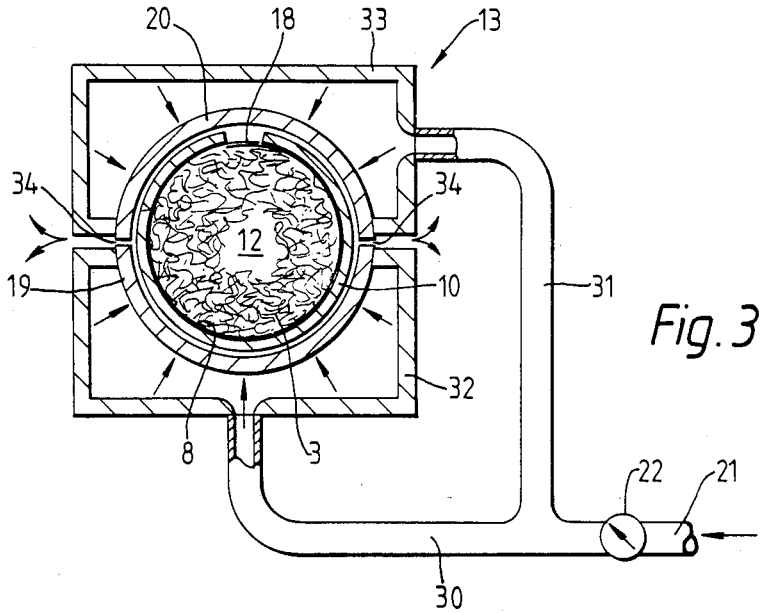
FIG. 3 is a cross-section on line III—III in FIG. 1 showing part (the filling pressure measuring device) in more detail.

FIG. 3 is a cross-section on line III—III in FIG. 1 of the air bearing arrangement 13. It shows the rod 12 comprising a tobacco filler formed by the trimmed stream 3 wrapped in paper web 8 sealed at a lap joint 18. The rod 12 is wrapped in the garniture tape 10, which is impervious to air, and is smooth and very flexible, e.g. is of basically woven construction but with an outer coating of elastomeric material.

The rod 12 and garniture tape 10 are enclosed in a cylindrical conduit formed by a garniture bed 19 and a cover block 20, each formed from an air-pervious sintered material having a uniform and relatively low permeability to air, each is moreover substantially semi-cylindrical and of uniform thickness so that the resistance coefficient of each with respect to radial air flow therethrough is substantially constant at various positions around the rod 12. Air pressure is supplied via a pipe 21 to pipes 30 and 31 leading to manifolds 32 and 33 respectively in which the members 19 and 20 are mounted. There may be ribs within the manifolds to support the members 19 and 20 (while maintaining an even air pressure around the members 19 and 20); alternatively, the spaces within the manifolds may be filled with high-permeability porous material, for example coarse sintered material.

The magnitude of the supply pressure is sufficient to compress the rod 12 very slightly so that the garniture tape is slightly spaced from the internal surfaces of the cylindrical conduit formed by the members 19 and 20. The gap so formed is very small: it is shown exaggerated in FIG. 3 to facilitate a clear illustration of the arrangement. Air is exhausted from the gap and into the atmosphere via slots 34 left between the adjacent edges of members 19 and 20. There may be additional exhaust slots. Alternatively, or in addition, air may be exhausted through a number of radial exhaust bores situated at various positions around and along the gap between the members 19 and 20 and the tape 10.

The supply pressure is kept constant, being just sufficient to avoid contact between the tape 10 and the members 19 and 20, and the air flow rate is monitored by a flow rate meter 22. Because the tape is smooth, the air flow through the gap is lamina flow, and the mean pressure in the gap is indicated by the total air flow rate. Moreover, since the tape is very flexible, the pressure in the gap at each location around the cigarette is substantially equal to the internal pressure (firmness) of the rod.

In practice, the garniture tape 10 does not fully enclose the cigarette rod 12. As shown in FIG. 3, the lap joint 18 is left exposed to avoid contamination of the tape 10 with glue. The part of the cover block 20 just above the lap joint is therefore preferably impervious to air.

The air pressure Pg in the gap also provides an air bearing which is advantageous even without the cigarette internal pressure measuring apparatus. The air bearing substantially reduces fricton between the cigarette and the conduit, thus reducing tape damage and conduit wear.

The air bearing may be provided solely on the garniture bed 19. In this case, if the internal rod pressure is to be monitored, the cover block 20 will be arranged to fit closely around the rod and garniture tape. The air bearing may be provided along the entire length of the garniture bed 19, including the portion accommodating the rod-forming arrangement 11 as shown in FIG. 1. However the internal pressure cannot be measured satisfactorily before the rod has been properly formed; therefore there is preferably a separate pressure supply to the air bearing under the rod-forming arrangement 11 which does not form part of the arrangement for measuring the internal pressure of the rod.

It will be appreciated that the air bearing of this Figure may be used independently of the other quality monitors of FIG. 1.

Instead of a constant pressure being supplied to the pipe 21, to produce a variable flow, the flow may be sent at a constant level, and the pressure in the pipe 21 (or possibly in the manifolds) is then detected as it again gives an indicator of the average internal pressure of the cigarette rod.

Figure 4:
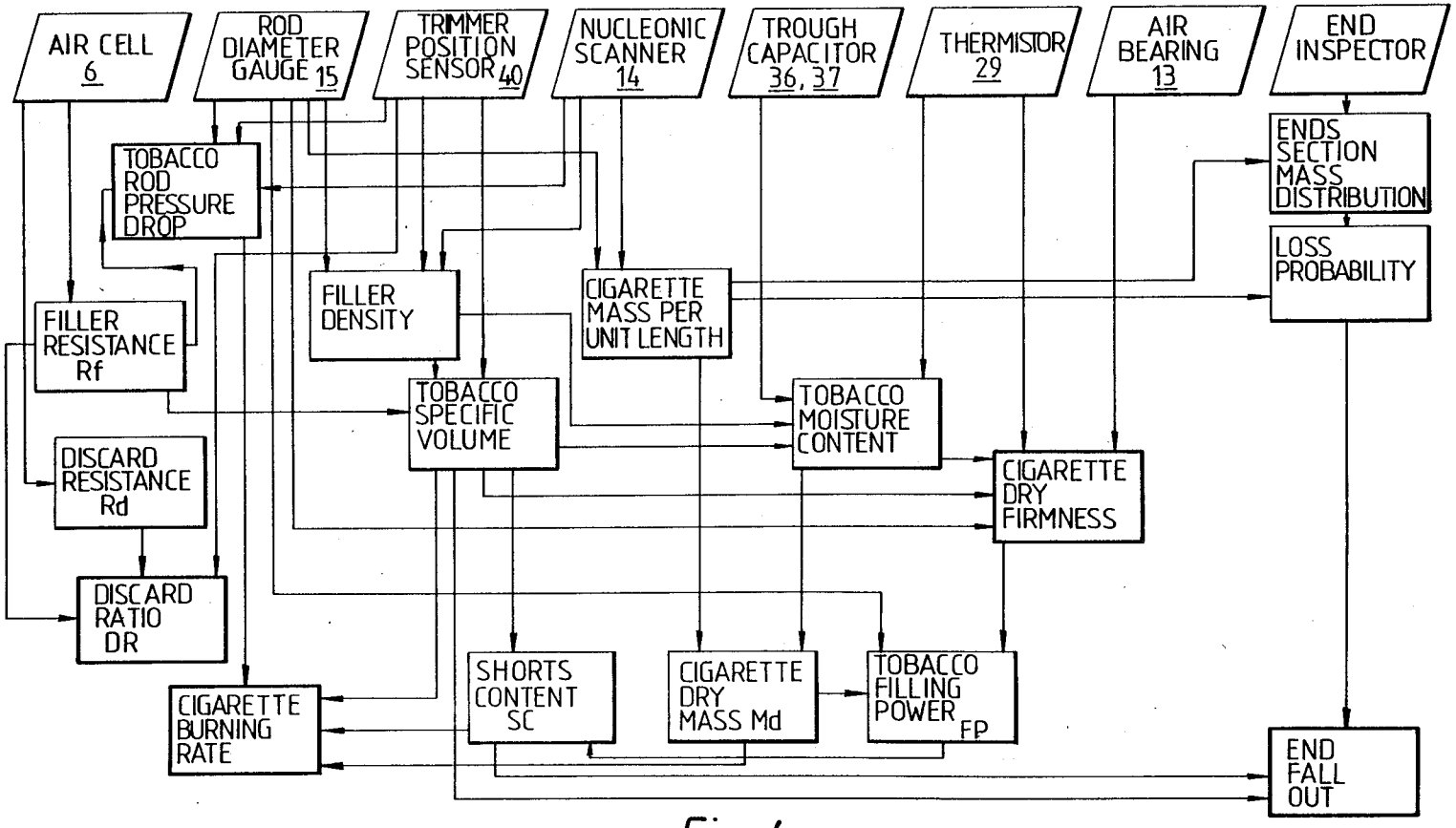
FIG. 4 is a flow diagram indicating the calculations performed by the microprocessor of FIG. 1.

FIG. 4 is a flow diagram illustrating the way in which the various quality data collected by various sensors of FIG. 1 are processed by microprocessor 16. The sensors are represented in the top row and are referenced consistently with FIG. 1, while the other boxes in FIG. 4 represent tobacco stream parameters calculated by the microprocessor 16 from the sensor measurements; the connecting arrows indicate which measurements are used to calculate each parameter.

Cigarette Dry Firmness

The cigarette dry firmness is calculated by the microprocessor 16 by obtaining an indication of the actual firmness of the rod in the cigarette making machine by compensating for effects due to water content and temperature. An indication of the actual firmness is obtained from the rod internal pressure measurement Pi while compensating, if necessary, for the effect on that measurement of any rod diameter change. The temperature of the tobacco is obtained from the temperature sensor 29. The relationship between temperature and dry firmness is such that the higher the temperature then the higher will be the calculated dry firmness. The calculation of moisture content is described below: again the higher the moisture content, the higher will be the calculated dry firmness.

The dry firmness, however, also depends on how the moisture is held by the tobacco, this depends upon the type of tobacco involved. Water within the tobacco fibres and tobacco particles may be inside the cells and is accordingly in large measure electrically bonded, or may be between the cells and is then termed "capillary water". A relatively high degree of bonding is accompanied by a relatively high degree of plasticity of the tobacco and thus reduces the measurement obtained for firmness. The calculation for dry firmness therefore has to be compensated accordingly if a high percentage of water present in the tobacco is bonded.

The degree of water bonding is indicated by the specific volume of the tobacco as defined above, since a relatively high degree of bonding is accompanied by a relatively low specific volume. The specific volume can be estimated from the value obtained for the resistance of the cigarette filler (i.e. that part of the tobacco stream which will be left on the conveyor 2 after trimming), taking into account also the density of the filler as derived mainly from the nucleonic scanner. An increase in specific volume for a given filler density will increase the filler resistance Rf because less space is available between the tobacco fibers and tobacco particles for the air flow to pass through.

The tobacco moisture content MC is calculated by comparing the filler density and its relative permittivity (dielectric constant) as indicated by the trough capacitor 36, 37. The relative permittivity of the tobacco varies according to the density of the filler but varies differently depending upon the component of density due to dry tobacco and the component due to moisture content. Moreover, the relative permittivity is different for bonded water and capillary water. Bonded water has a smaller effect on the relative permittivity than capillary water, so that the moisture content value obtained must be increased with increased water bonding. This is again achieved by taking the specific volume into account. This is particularly important with modern tobacco blends including "puffed" tobacco.

Tobacco Rod Pressure Drop (PD)

The tobacco rod pressure drop (i.e., the pressure drop which can be expected to occur through the tobacco of the cigarette during smoking) is calculated by microprocessor 16 as a function of the filler resistance Rf as measured by air cell 6, the cigarette rod diameter D, the filler thickness H and the indication of the mass per unit length m obtained from the nucleonic scanner.

Cigarette Burning Rate

This is calculated by microprocessor 16 from the tobacco rod pressure drop PD, the tobacco specific volume, the tobacco shorts content SC and the cigarette dry mass Md (obtained from a calculation of actual cigarette mass and the moisture content). The specific volume is obtained in the manner described above, in relation to cigarette dry firmness calculations. The shorts content SC is calculated as a function of the specific volume and the tobacco filling power FP, which is a function of the cigarette dry mass Md, the cigarette rod diameter and the cigarette dry firmness.

The relationship is as follows. The higher the tobacco rod pressure difference, the lower the burning rate; the higher the specific volume, the higher the burning rate; the higher the shorts content, the higher the burning rate; and the higher the dry weight, the lower the burning rate.

End Fall Out

The likelihood of tobacco falling out of the ends of the completed cigarettes at some stage before the cigarettes are packed can be estimated since it is directly related to the shorts content SC and inversely related to the specific volume; i.e. the optimum (low) end fall out results are obtained by minimum shorts content SC and maximum specific volume. End fall out is also dependent upon the loss probability P(1) which is calculated as a function of the rod mass per unit length M and the ends section mass distribution obtained from an ends inspector (not shown) which may take various forms.

I claim:

1. A method of determining the internal pressure and thereby the firmness of an axially moving cigarette rod, comprising wrapping an endless impervious flexible tape at least partly around the rod, passing the wrapped rod through a guide, supplying air under pressure to the guide to produce a gap between the tape and the guide, and monitoring a physical characteristic of the supplied air to provide a measurement of the internal pressure of the rod-shaped article.

2. A method according to claim 1 in which the flexible tape is a garniture tape which serves also to form the cigarette rod by wrapping around a tobacco filler a continuous paper web.

3. A method according to claim 1 or claim 2 in which air is supplied to the guide at constant pressure, and the air flow rate is monitored.

4. A method according to claim 1, further comprising the step of compensating said internal pressure measurement on the basis of the moisture content and the specific volume of the tobacco forming the filler of the cigarette rod to produce a signal representing the dry firmness of the cigarettes to be produced from the cigarette rod.

5. A method according to claim 4, further comprising the step of varying the amount of tobacco used in the formation of the cigarette rod in response to said signal representing the dry firmness of the cigarettes.

6. A method according to claims 4 or 5, further comprising the step of detecting the specific volume of the tobacco used to form the cigarette rod by measuring the resistance to air flow of the tobacco prior to formation of the tobacco filler and by detecting the density of the tobacco during the air resistance measurement.

7. A method according to claim 6, further comprising the step of measuring the moisture content of the tobacco by means of a capacitance device.

8. A method according to claim 6, further comprising the steps of forming on a conveyor a stream of tobacco which is to comprise the tobacco filler of the cigarette rod, trimming said tobacco stream to a predetermined height, sensing the air pressure in the tobacco stream at a first position spaced from the conveyor carrying the tobacco stream and comparing the sensed air pressure with the pressure at a second position above or below the tobacco stream to provide an indication of the specific volume of the tobacco.

9. A method according to claim 8, in which the first position corresponds approximately to the average trimming level, and in which a signal indictive of the actual level at which the tobacco stream is being trimmed is used as a compensatory factor in the comparison.

10. A method according to claim 9, in which the second pressure is adjacent to the conveyor carrying the tobacco stream.

11. A method according to claim 10 in which the pressure drop indicated by the pressure comparison is in turn compared with the pressure drop through the entire tobacco stream to give an indication of the proportion of the tobacco that is removed by the trimmer.

12. A method according to claim 4, wherein said internal pressure measurement is also compensated on the basis of the temperature of the tobacco.

13. Apparatus for determining the internal pressure of an axially moving cigarette rod comprising means for forming a continuous rod in which a wrapper web surrounds a tobacco filler including an endless impervious flexible tape arranged to be wrapped around at least part of the circumference of the rod; a guide; means for causing said rod and tape to pass through said guide; means for supplying air under pressure to the guide to enter a gap between the guide and the tape; and monitoring means for monitoring a physical characteristic of the supplied air.

14. Apparatus according to claim 13 in which the flexible tape 10 is a garniture tape which serves also to form the cigarette rod by wrapping the wrapper web around the tobacco filler.

15. Apparatus according to claim 13 or claim 14 in which the air is supplied at a substantially constant pressure, and the monitoring means is arranged to monitor the air flow rate.

16. Apparatus according to claim 13 in which the guide is formed of an air-previous material.

17. Apparatus according to claim 16 in which the guide comprises upper and lower parts each of semi-cylindrical shape.

18. Apparatus according to claim 16 or claim 17 in which the guide is mounted in a manifold into which the air is supplied.

19. Apparatus according to claim 18 in which two adjacent parts of the guide have separate manifolds and are spaced apart whereby at least one gap between them allows for venting the supplied air.

20. Apparatus according to claim 18 in which the manifold is filled with a porous material which supports the guide.

21. Apparatus according to claim 16 in which the edges of the flexible tape are spaced apart so as not to contact the seam of the cigarette wrapper, and in which the part of the guide which is adjacent to the seam is impervious.

22. Apparatus according to claim 3 or claim 14 in which the air supplied to the guide forms an air bearing between the guide and the flexible tape.

23. Apparatus according to claim 22 in which a separate air supply is provided for the guide at a first section of the tape where the rod conveyed at this section is not fully formed.

24. A method of monitoring a tobacco stream which, after trimming, is enclosed in a wrapper web to form a continuous cigarette rod, in which the air pressure in the tobacco stream is sensed at a first position spaced from a conveyor carrying the tobacco stream and is compared with the pressure at a second position above or below the tobacco stream.

25. A method according to claim 24 in which the first position corresponds approximately to the average trimming level, and in which a signal indicative of the actual level at which the tobacco stream is being trimmed is used as a compensatory factor in the comparison.

26. A method according to claim 24 or claim 25 in which the second pressure is adjacent to the conveyor carrying the tobacco stream.

27. A method according to claim 26 in which the pressure drop indicated by the pressure comparison is in turn compared with the pressure drop through the entire tobacco stream to give an indication of the proportion of the tobacco that is removed by the trimmer.

28. A cigarette making machine in which a tobacco stream is formed on a suction conveyor and is then trimmed before being enclosed in a wrapper web to form a continuous cigarette rod, characterised in that a channel is formed in a side wall confining one side of the tobacco stream at a position upstream of the trimmer to detect the air pressure in the tobacco stream at a level corresponding approximately to the average level at which the tobacco stream is trimmed by the trimmer.

29. A machine according to claim 28 including means for indicating the actual level at which the tobacco stream is being trimmed, and means for determining the amount of discard tobacco removed by the trimmer, taking into account the said air pressure and the actual trimming level.

30. A machine according to claim 29, including a second channel whereby the air pressure in the tobacco adjacent to the conveyor is detected.

31. A machine according to claim 30 including means for comparing the pressure signals from the two channels to determine the proportion of tobacco (the discard ratio) removed by the trimmer.

32. A method of determining the dry firmness of cigarettes in which the firmness is measured at the time of making the cigarettes, and the signal obtained thereby is compensated by reference to the moisture content of the tobacco and by reference to the specific volume of the tobacco.

33. A method according to claim 32 in which the specific volume of the tobacco is determined or estimated by measuring the resistance to air flow of the tobacco used in the formation of the cigarette and by taking into account also the density of that tobacco during the air resistance measurement.

34. A method according to claim 32 or claim 33 in which the moisture content of the tobacco is measured by means of a capacitance device.

35. A method according to claim 34 in which the signal obtained is also compensated by reference to the temperature of the tobacco.

36. A method according to claims 32 or 33 in which the amount of tobacco used in the formation of the cigarettes is varied in response to the dry firmness of the cigarettes.

* * * * *